US009091439B2

(12) United States Patent
Brown

(10) Patent No.: US 9,091,439 B2
(45) Date of Patent: Jul. 28, 2015

(54) CHIMNEY DAMPER

(76) Inventor: Lawrence A. Brown, Pekin, IN (US)

( * ) Notice: Subject to any disclaimer, the term of this patent is extended or adjusted under 35 U.S.C. 154(b) by 301 days.

(21) Appl. No.: 13/068,502

(22) Filed: May 12, 2011

(65) Prior Publication Data

US 2012/0028558 A1 Feb. 2, 2012

Related U.S. Application Data

(60) Provisional application No. 61/395,254, filed on May 12, 2010.

(51) Int. Cl.

| | |
|---|---|
| ***F23J 13/08*** | (2006.01) |
| ***F23L 11/00*** | (2006.01) |
| ***F23L 13/00*** | (2006.01) |

(52) U.S. Cl.

CPC ..... *F23J 13/08* (2013.01); *F23L 11/00* (2013.01); *F23L 13/00* (2013.01)

(58) Field of Classification Search

CPC ..... F23J 13/08; F23L 11/00; F23L 13/00
USPC ..... 454/4, 7, 35
See application file for complete search history.

(56) References Cited

U.S. PATENT DOCUMENTS

| | | | | | |
|---|---|---|---|---|---|
| 410,660 | A | * | 9/1889 | Turner | 454/4 |
| 944,831 | A | * | 12/1909 | Terramorse | 454/4 |
| 1,183,804 | A | * | 5/1916 | Determann | 454/358 |
| 1,204,702 | A | * | 11/1916 | Schupp | 454/29 |
| 1,483,784 | A | * | 2/1924 | Collver | 236/45 |
| 2,211,367 | A | * | 8/1940 | Davey et al. | 454/107 |
| 2,242,738 | A | | 5/1941 | Alton | |
| 2,313,350 | A | | 3/1943 | Lebus | |
| 3,022,717 | A | * | 2/1962 | Webster | 454/4 |
| 3,101,039 | A | * | 8/1963 | Duchene et al. | 454/4 |
| 3,267,832 | A | * | 8/1966 | Hinkle | 454/4 |
| 4,007,730 | A | * | 2/1977 | Heebink | 126/286 |
| 4,020,754 | A | * | 5/1977 | Dalsin et al. | 454/4 |
| 4,142,457 | A | * | 3/1979 | Zaniewski | 454/38 |
| 4,181,119 | A | * | 1/1980 | Lyles | 126/286 |
| 4,256,257 | A | * | 3/1981 | Pinkerton | 236/1 G |
| 4,481,933 | A | | 11/1984 | Sawtelle | |
| 4,554,863 | A | * | 11/1985 | Dalsin | 454/4 |
| 5,080,006 | A | * | 1/1992 | Vonsick | 454/7 |
| 5,094,050 | A | * | 3/1992 | Jenkins | 52/218 |
| 5,125,869 | A | * | 6/1992 | VonSick | 454/4 |
| 5,295,901 | A | * | 3/1994 | Sexton | 454/4 |
| 5,437,574 | A | * | 8/1995 | Sexton | 454/4 |
| 5,556,329 | A | * | 9/1996 | VonSick | 454/4 |
| 5,669,811 | A | * | 9/1997 | Zaniewski | 454/16 |

(Continued)

*Primary Examiner* — Steven B McAllister
*Assistant Examiner* — Jonathan Cotov
(74) *Attorney, Agent, or Firm* — Carrithers Law Office PLLC

(57) ABSTRACT

A chimney damper for round flues that includes a rigid peripheral frame surrounding an open window area, a cap moveable toward and away from the open window to selectively close and open the same and springs interconnecting the cap and frame resiliently urging the cap to an open position. The square, rectangular, or round frame includes a shirt adapted to form or connect to a cylindrical base which comprises a round open window and thus can be configured for use on a round flue. The springs are preferably torsion springs and are located within the cap assembly and the open window area defined by the peripheral frame. The cap is guided during its movement toward and away from the frame by the springs and during such movement the cap rotates a partial turn relative to the frame to which it is connected by the springs.

16 Claims, 4 Drawing Sheets

(56) References Cited

U.S. PATENT DOCUMENTS

| | | | | | |
|---|---|---|---|---|---|
| 5,848,931 | A | * | 12/1998 | Dortzbach | 454/4 |
| 5,857,904 | A | * | 1/1999 | Van Horn | 454/4 |
| 5,876,282 | A | * | 3/1999 | Kenny | 454/367 |
| D416,615 | S | * | 11/1999 | Brummer | D23/374 |
| 6,921,327 | B2 | * | 7/2005 | Urash | 454/5 |
| 7,422,519 | B2 | * | 9/2008 | Brown | 454/4 |
| 2005/0197055 | A1 | * | 9/2005 | Jensen | 454/12 |
| 2005/0250433 | A1 | * | 11/2005 | Brown | 454/4 |
| 2008/0096480 | A1 | * | 4/2008 | Parry | 454/4 |

* cited by examiner

CHIMNEY DAMPER

CROSS REFERENCE TO RELATED APPLICATIONS

This application claims priority from U.S. Provisional Application Ser. No. 61/395,254 filed on May 12, 2010 is incorporated by reference herein in its entirety. Reference to documents made in the specification is intended to result in such patents or literature cited are expressly incorporated herein by reference, including any patents or other literature references cited within such documents as if fully set forth in this specification.

TECHNICAL FIELD OF INVENTION

This invention relates generally to a spring biased chimney damper including locking mechanism and more particularly to improvements thereto.

BACKGROUND OF INVENTION

The application incorporates by reference Applicant's U.S. Pat. No. 7,422,519 which issued on September, 2008 and published as publication US 2005/0250433 on Nov. 10, 2005 from application Ser. No. 11/080/355 filed on Feb. 17, 2005 and claims priority from U.S. application Ser. No. 10/927,783 filed on Aug. 27, 2004, now abandoned.

The prior art shows various type of dampers without and without spring means to hold the cap away from the frame in or on the chimney flue when not in use. For instance, U.S. Pat. No. 5,125,869 granted on Jun. 30, 1992, and U.S. Pat. No. 5,556,329 granted on Sep. 17, 1996 disclose a conventional spring biased chimney damper.

Typically, these prior art devices include a frame defining an open window area, a cap for selectively covering and uncovering the open window area, and spring means inter connecting the cap and frame and biasing the cap to it's open position. The springs are multi-component and connected to the frame outside of the window area. There may be a poorly designed alignment means to align the cap over the window opening as it is operative only the final phase of it's movement to the closed position. No means is provided for selectively adjusting the spacing between the cap and the frame in the cap open position.

Some chimney dampers include a lock mechanism to keep the damper in an open position in case of a chimney fire comprising a fusible link connected to spring means and in case of over heating, due to for example a chimney fire, the link melts causing the spring to move into a position in which it locks the cap in an open position. This fusible link must be replaced after each occurrence of overheating and because of the in use position of the damper on top of the chimney it is difficult to replace.

Moreover, some chimney damper embodiments require that the cap turn a quarter turn during each of the closing and opening movements. In another embodiment, the cap does not rotate and is captive in an outer skeleton frame limiting movement of the cap to reciprocal movement only wherein the spring system is connected to a plate that can move reciprocally on a shaft as well as rotate on that shaft.

SUMMARY OF THE INVENTION

The chimney damper disclosed in the present invention includes a rigid peripheral frame surrounding an open window area corresponding generally to that of an end of the flue having a square, rectangular, or round shape. The frame includes a shirt extending inwardly therefrom adapted to form or connect to a cylindrical base which comprises a round open window and thus can be configured for use on a round flue. A cap is included for covering the open window area. A round plate connecting to the bottom of the cap is interposed between the cap and the frame base. Spring means interconnecting the frame base and plate causes the plate to rotate relative to the frame base during opening and closing of the damper. The spring means biases the plate and cap connected thereto in a direction away from the frame base to a window open position. The plate and cap rotate together as the device is opened and closed. Since the cap is round, it causes no interference with proximal objects or structures.

A further object of the present invention is to provide a means as described above while at the same time avoiding the use of an external frame for guiding the cap during it's movement toward an open and closed position.

Another object of the present invention is to provide an improved means for maintaining alignment of the cap outer downwardly directed peripheral flange with the upwardly directed outer peripheral flange on the chimney flue mounting flange.

An object of the present invention is to provide an improved spring arrangement biasing the cap to an open position.

A further object is to provide a spring arrangement which is self guiding and requires no additional guide means for aligning the cap over the open window area of the frame.

Another object of the present invention is to provide a chimney damper for use on round flues.

Another object of the present invention is to provide a chimney damper which is inexpensive and easy to manufacture with relatively few moving parts.

In keeping with the forgoing there is provided a flue damper comprising: a rigid peripheral frame surrounding an open window area, said open window area being round, a round cap for covering said open window area, said cap being large enough to receive the round portion of said rigid peripheral frame, and spring means connecting said cap assembly to said frame, said spring means being located within said open window area and biasing said cap assembly in a direction away from said frame to a window open position, said cap assembly being forceably movable against said resilient bias toward said frame to overlie and thereby close said open window, and wherein said spring means includes at least three torsion spring members biasing said cap assembly from said window frame and capable of guiding said cap assembly to close said window without further guide means.

More particularly, the chimney damper of the present invention includes a rigid first peripheral frame surrounding an open window area, a cap including a plate of slightly smaller diameter nested or affixed to the underside of the cap, wherein movement of the plate and cap toward and away from the open window to selectively close and open the same is accomplished by a plurality of springs interconnecting the plate with a base of the frame resiliently urging the cap to an open position. One end of the springs are connected to the top of the plate and the other ends of the springs are pivotally attached to the base of the frame. The cap is mounted on the plate and allowed to pivot relative to the base. The springs and the arrangement thereof are such as to cause the plate and cap to rotate relative to the frame base during opening and closing of the damper with the rotation being about one quarter turn.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the several views and wherein.

DETAILED DESCRIPTION OF THE PREFERRED EMBODIMENT

Figure 7:
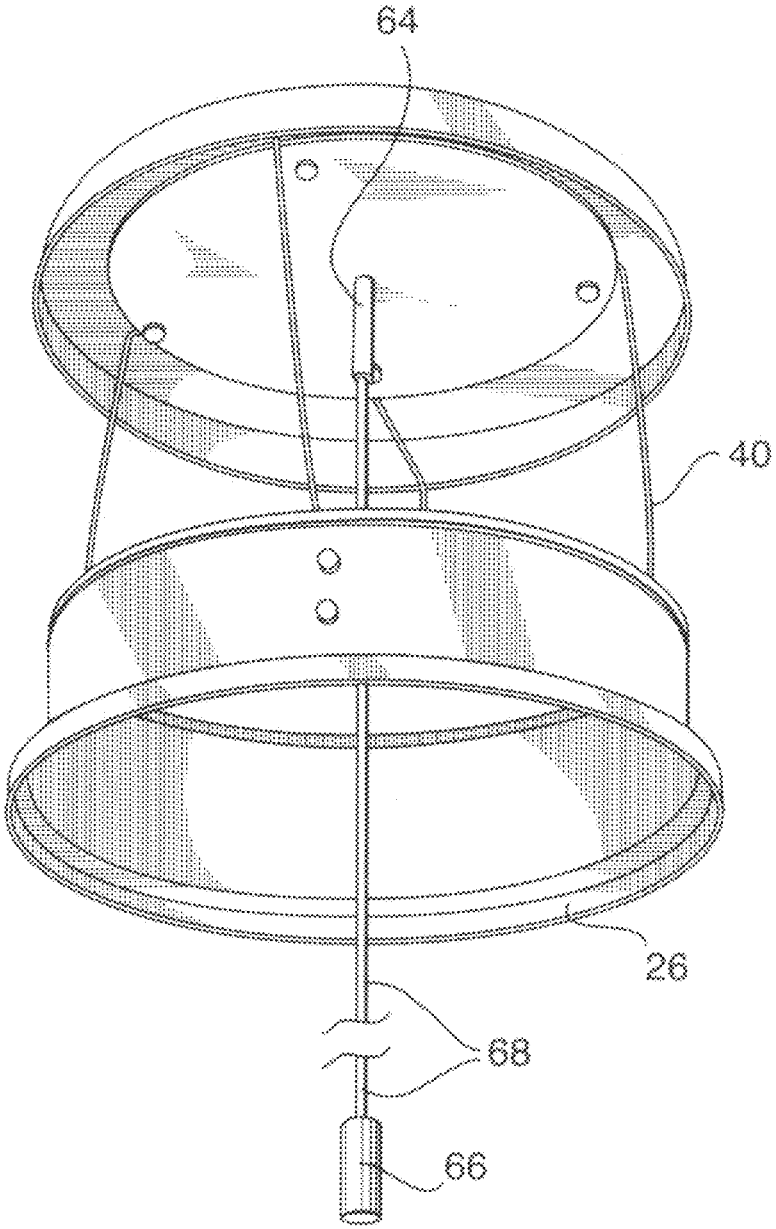
FIG. 7 is a perspective view of a chimney damper configured to fit a round flue.

As best illustrated in the figures, a preferred embodiment of the chimney damper 10 comprises a frame 20 having a peripheral lip extending along a edge thereof for mounting to a brick or concrete or metal flue pipe or chimney. A flange 24 of skirt 25 extends from the peripheral edge of the frame 20 connecting to a short cylindrical base 23 extending upward therefrom sized in accordance with the flue pipe. The damper frame 20 includes an open window area 21 that is selectively opened and closed by moving a cap 30 upward or downward respectively away from and toward the frame 20. As shown in FIGS. 1-6, frame 20 has a peripheral flange 24 configured to fit onto a square flue. The cap 30 is connected to a disk or plate 46 by an eyebolt 34 extending from the bottom surface of the plate 46 through a spacer 64 and a center hole of the plate and secured by a nut 32. An alternate embodiment shown best in FIG. 7 shows a cylindrical base 23 having a cylindrical flange 26 extending around the bottom periphery thereof for cooperative engagement with a round flue pipe.

The plate or disk 46 is connected to the cylindrical base 23 of the frame 20 by a plurality of springs 40, each one connected at its coiled bottom end by a spring retainer assembly 17 including a shoulder screw 22 with a washer and nut 15 to stop brackets or lugs 58 that are affixed to the inside wall of base 23. The rotating medial torsion arm portion 43 of the spring 40 extends upward at an angle toward the outside periphery 13 of the plate 46 and over and across the top of the plate 46 secured by a grooved clip 52 acting as a hinge to allow the top portion 42 of the torsion arm spring 40 to twist/torsion across the top of the plate 46.

Figure 1:
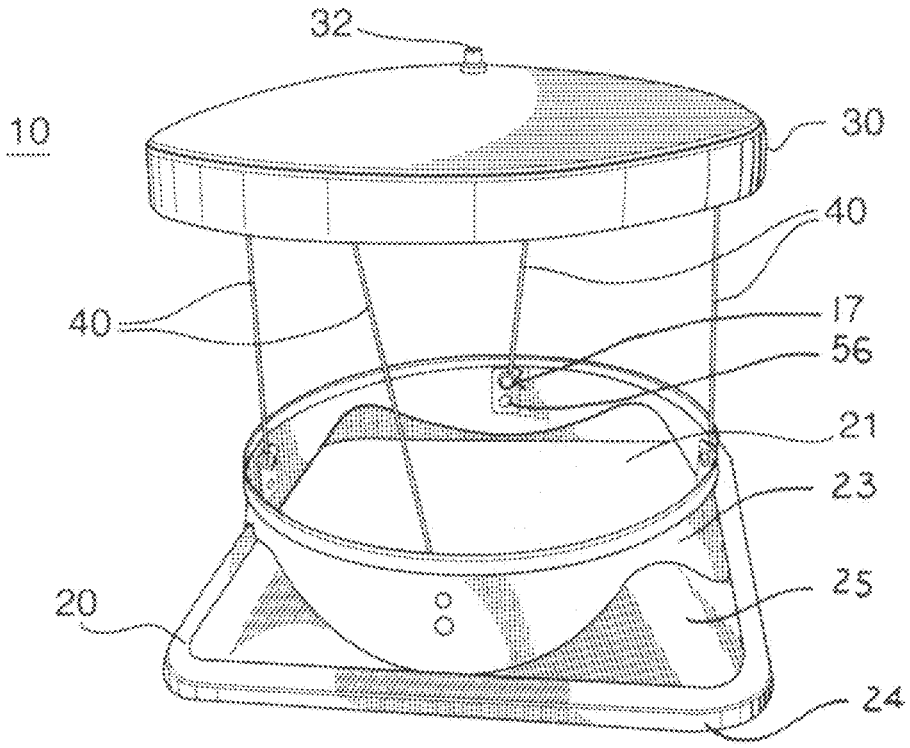
FIG. 1 is a perspective front view of a chimney damper showing the cap connecting to the base and peripheral frame.
Figure 2:
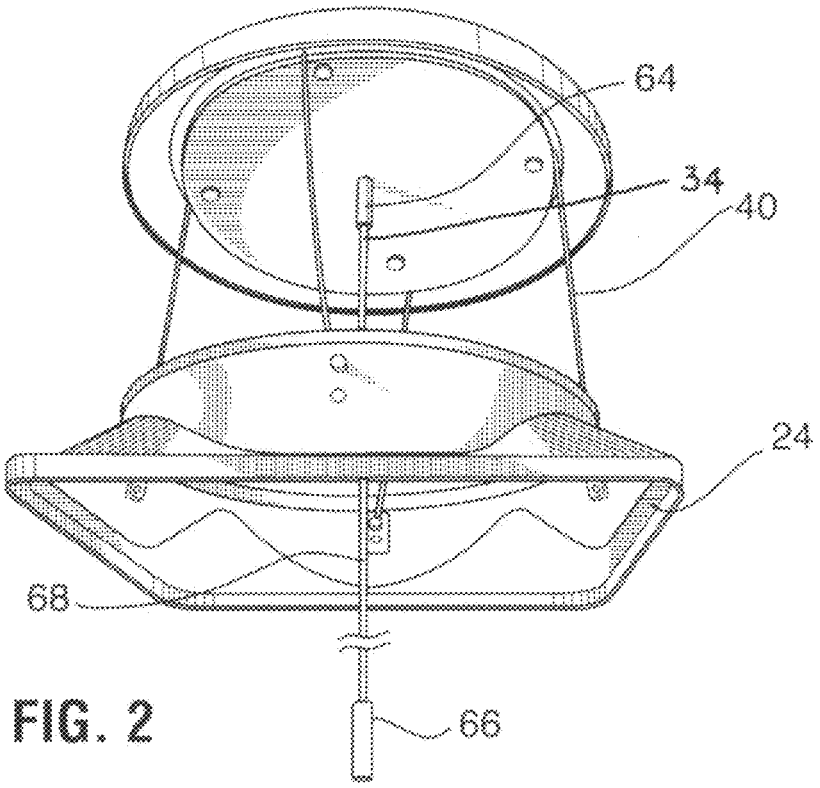
FIG. 2 is a perspective front view of the chimney damper of FIG. 1 showing a plate affixed to the underside of the cap and the ends of the springs extending from the frame base.
Figure 3:
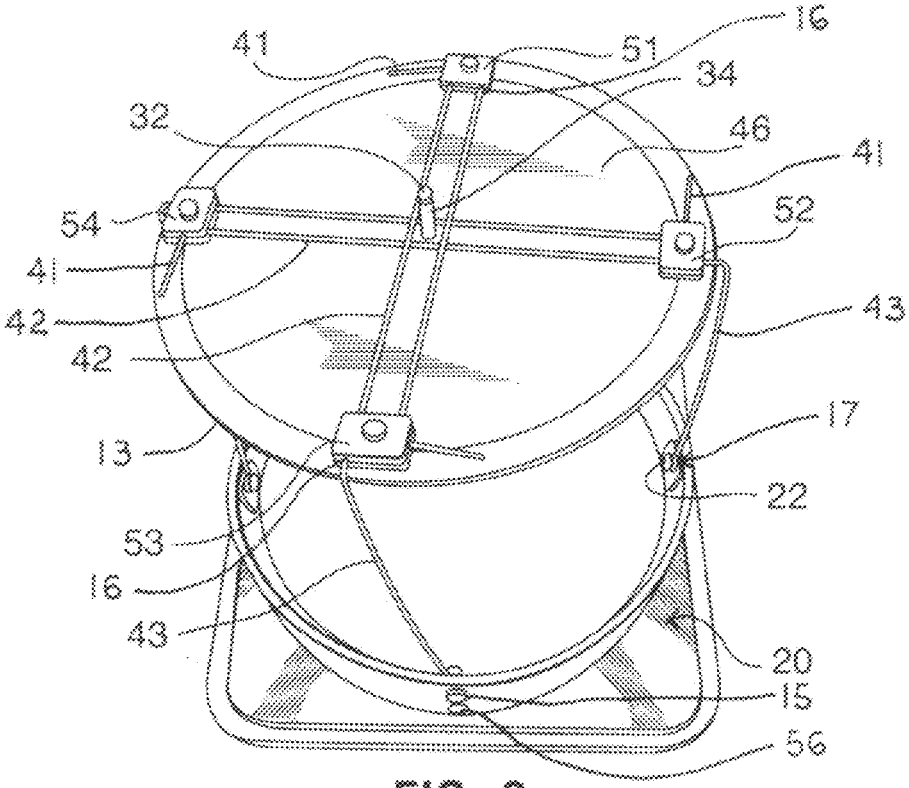
FIG. 3 is a perspective upper view showing a top of the plate with the cap removed and exposing the hidden torsion spring portions which extend up and over the periphery of the plate and across the top of the plate.
Figure 5:
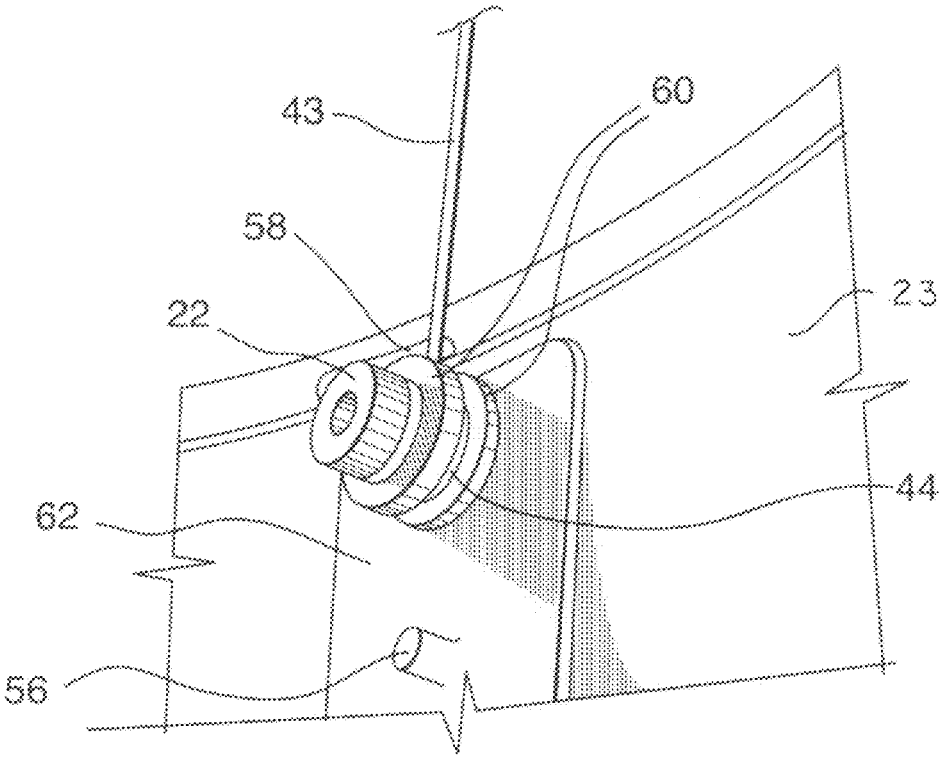
FIG. 5 is a side view of the spring attachment and stop lug.
Figure 6:
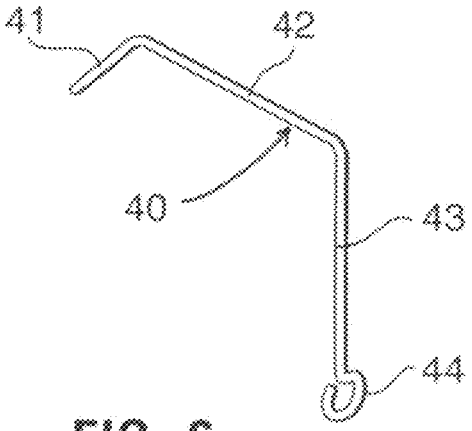
FIG. 6 is an oblique view of a torsion spring.

As shown in FIGS. 3 and 5, cap 30 has been removed from disk 46. Spring means comprises a plurality of torsion springs 40. As shown in the preferred embodiment, four wire torsion springs 40 are employed, each one secured by a spring retainer assembly 17 consisting of a stop torsion arm portion 41, a top horizontal rotating torsion arm portion 42, a medial torsion arm portion 43, and a coiled portion 44 at a bottom distal end, a bracket 62, and lug 56 prevent rotation of the bracket 62. The arm portion 43 of the spring 40 is pivotally anchored to frame base 23 by a coiled portion 44. The coiled portion 44 is held by a pin 15, washers 60, and a nut 22 secured to frame base 23 and projects into an open window area 21. Bracket 62 is fastened to frame base 23. Lug 58 on bracket 56 acts as a stop for arm 43 preventing it from rotating up to a perpendicular attitude when damper 10 is open. Therefore, lug 58 keeps arm portion 43 biased toward a closing attitude so that when the plate 46 and cap 30 is first urged toward frame 20, it starts smoothly rotating in a controlled manner in a clockwise direction as viewed from above.

Each one of the springs 40 extends upward and are bent at a right angle over the top of the outer peripheral edge 13 of the plate 46 extending to the opposing side of the plate 46 and retained by a clip or bracket positioning means 4 by a screw and nut fastener. As shown best in FIGS. 3-4, the medial torsion arm portion 43 extends upwardly from the coiled portion 44 over the plate where it is rotatably held against the top surface of the plate and retained by a bracket 52 having a retaining groove 16 formed in a bottom surface thereof. The horizontal top torsion arm portion 42 of spring 40 extends across the plate and bent at a right angle forming a short segment defining a stop torsion arm portion resting on the surface of the plate and held in place by the opposing clip disposed in a groove 16 formed on the underside surface thereof.

The wire springs bend and lie between the cap 30 and frame base 23 when the damper is in it's closed state. To accomplish this it is necessary for the plate 46 to rotate a partial turn, (approximately one quarter turn), relative to the frame. The cap is mounted on the plate 46 by a coupling means or nut 32 fastened to a threaded distal end of an eye bolt 34 extending through a hole in the cap 30 which rests on the spacer 64 and allowed to rotate with the plate 46. Moreover, the device can be modified for use with hexagonal, octagonal or other unusually shaped chimney openings.

Opening and closing the damper is accomplished by rotation of the plate 46 and compression of the springs and lowering the cap toward the frame base 23. The cable 68 is attached to the spacer 64 at its upper free end and extends down through the flue and into the upper fireplace where a handle 66 is connected at its lower free end. Thus, a user can pull handle 66 to close or reduce the volume of the damper 10. In its open position, when damper 10 is closed by pulling handle 66, the arms 43 will be urged in a downward direction from a near vertical position toward a horizontal position which causes the plate 46 to rotate in a clockwise position and cap descend toward the frame base 23.

The cap may optionally utilize a seal means for example maybe a 'U"-shape rubber, or the like gasket member 27 that fits onto the upper edge of the flange at the top of the frame base 23. It provides sealing contact with the under face of the cap when the latter is in it's closed position covering the open window of the frame. Obviously the gasket could be made of suitable material such as graphite, silicon, soft metal, or synthetic polymer materials to withstand heat that would be encountered even when a chimney fire occurs.

It is contemplated that cable 68 could be replaced with a chain, rod or any other attachment means appropriate for pulling cap 30 toward frame 20.

As shown best in FIG. 3, the spring arm portion 43 forms an approximate right angle to the torsion arm portion 42. It is not necessary that this be a right angle, but it must be an angle that allows rotating arm 43 to twist and therefore apply a torque to arm portion 42. Likewise, torsion arm portion 42 forms an approximate right angle with stop arm portion 41. And similarly, it is not necessary that this be a right angle, but it must be an angle that allows arm portion 41 to prevent torsion arm portion 42 from turning freely.

Arm portions 42 and 43 of spring 40 are pivotally attached to the plate 46 by a block 53 disposed on the upper surface close to the outer edge along the periphery of the plate. Each one of the arm portions 42 and arm portions 41 are attached to a respective block 51 evenly spaced apart from one another along the periphery of the plate 46. As the cap 32 and plate 46 are pulled toward frame 20, arm 43 is rotated toward frame 20 because coil portion 44 rotates around spacer 64. This rotating motion allows torsion arm portion 42 to twist within blocks or brackets 51 and 53 or the corresponding brackets for the other springs 40. Therefore a torsion effect is realized within arm portion 42, which acts as a torsion spring.

Figure 4:
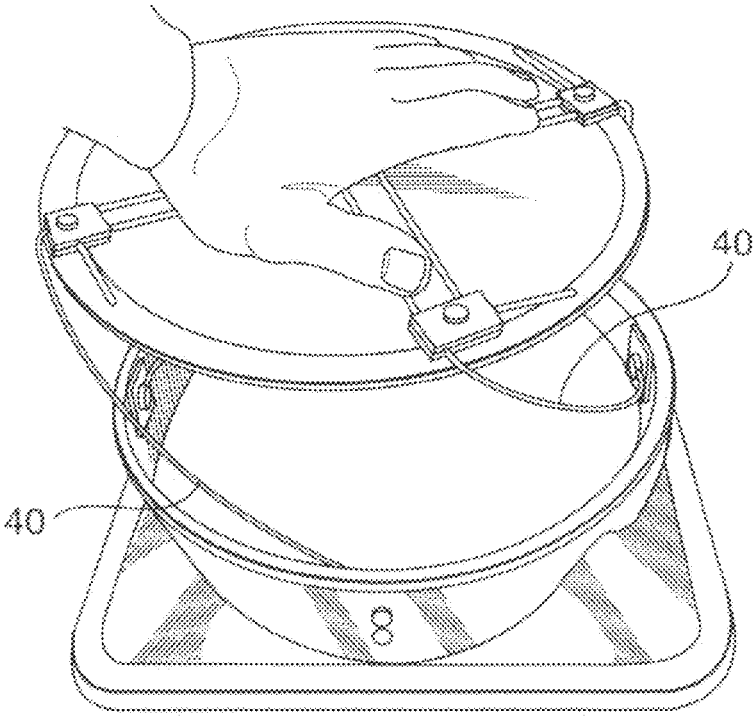
FIG. 4 is a perspective view without the cap and showing the damper in a partially closed condition whereby the plate is rotated with respect to the frame base and compressed thereby.

As shown in FIG. 4, all four springs 40 react in the same way and therefore guide disk 46 and cap 30 down to frame 20 in a rotating manner.

Other embodiments could use three, five or more evenly spaced torsion springs to bias the cap assembly above the frame. Also, note that with the torsion springs evenly spaced and pivotally connected to the frame as shown, no other guiding means is necessary. The springs keep the damper cap in alignment as it is urged down onto the window frame.

Frame 20 is shown in FIGS. 1-4 in a configuration wherein a round window 21 has been configured within frame 20 which fits a square flue. Another embodiment contains a frame which is configured to fit a rectangular flue. The chimney cap maybe manufactured in rectangular or square configurations that fit conventional flues of the following nominal sizes: 8"×8"; 8"×17"; 9"×13"; 13"×13"; 13"×18"; 18"×18" or any size circular flue as well.

Still another embodiment, shown in FIG. 7, contains a frame with flange 26 which is configured to fit a round flue.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

I claim:

1. A flue damper comprising:

a frame comprising a cylindrical frame base having a top peripheral edge surrounding an open window area and a bottom peripheral edge with a flange sized and shaped for cooperative engagement with a top distal end of a flue;

a rotatable plate in alignment with and connecting to said cylindrical frame base by a plurality of torsion springs for urging said plate away from said top peripheral edge of said cylindrical frame base, said plate is round with a diameter less than said peripheral edge of said cylindrical frame base where upon compression of said torsion springs lowers said plate within said cylindrical frame base and a cap cooperatively engages said peripheral edge of said cylindrical frame base;

said cap for covering said open window area and said plate, said cap sized and shaped for cooperative engagement with said top peripheral edge of said cylindrical frame base;

means attaching said plate to said cap and for pulling said plate and said cap downward for cooperative engagement with said top peripheral edge of said cylindrical frame base;

retainer means for rotational attachment of a distal end of said torsion springs to said cylindrical base frame;

means for limiting rotational movement of said torsion springs with respect to said means for attaching said torsion springs to said cylindrical base frame;

each one of said torsion springs attaching to said cylindrical frame base extending upward to said plate, said torsion spring bent at a selected angle for extending from said peripheral edge of said plate and held in rotatable position by a first positioning means attached to a surface of said plate, said torsion spring extending across said surface of said plate and rotatably held in position by a second positioning means attached to said surface of said plate, said distal end of said torsion spring extending from said second positioning means at a selected angle biased against said surface of said plate defining a stop means whereby upward or downward motion of said plate in alignment with said cylindrical base frame results in bending and twisting of said torsion springs; and whereby pulling said means for attaching said cap to said plate simultaneously bends, twists, and compresses said torsion springs against resilient bias toward said top peripheral edge of said cylindrical frame base wherein said cap cooperatively and releasably engaging said top peripheral edge of said cylindrical frame base.

2. The flue damper as defined in claim 1 includes at least three torsion springs.

3. The flue damper as defined in claim 2 with said torsion springs having a coiled portion pivotally connected to said frame, said coiled portion having a rotating arm extending therefrom, said rotating arm having a torsion arm extending at an approximate right angle therefrom, said torsion arm having a free outer arm extending at an approximate right angle therefrom, means connecting said free outer arm to said cap assembly, and means rotatably connecting said torsion arm to said cap assembly.

4. The flue damper as defined in claim 1 wherein said means attaching said plate to said cap and for pulling said plate and said cap downward for cooperative engagement with said top peripheral edge of said cylindrical frame base means comprises a cable and handle combination, said cable having a first free end connected to said cap assembly and a second free end connected to said handle.

5. The flue damper of claim 1, including a spacer means disposed between said plate and said cap.

6. The flue damper of claim 1, wherein said positioning means comprises a clip.

7. The flue damper of claim 6, wherein said clip includes grooves therein for holding said torsion spring in a rotatable position.

8. The flue damper of claim 1 wherein means for preventing rotational movement of said torsion spring with respect to said means for attaching said torsion springs to said cylindrical base frame comprises a lug affixed thereto in cooperative engagement with said torsion spring.

9. The flue damper of claim 1 wherein means for attaching said cap to said plate and for pulling said cap and plate downward comprises a nut and eye bolt assembly connecting to a means for pulling.

10. The flue damper of claim 1, wherein said frame includes a skirt extending from a bottom peripheral edge of said cylindrical frame base, said skirt including a peripheral flange of a selected size and shape for cooperative engagement over a top distal end of a flue having a corresponding size and shape.

11. The flue damper of claim 1, wherein each one of said torsion springs extend over a top peripheral edge of said plate and are bent at a selected acute angle.

12. The flue damper of claim 1, wherein said plate is round with a diameter less than said peripheral edge of said cylindrical frame base where upon compression of said torsion springs lowers said plate within said cylindrical frame base and said cap cooperatively engages said peripheral edge of said cylindrical frame base.

13. A flue damper comprising:

a frame comprising a cylindrical frame base having a top peripheral edge surrounding an open window area and a bottom peripheral edge with a flange sized and shaped for cooperative engagement with a top distal end of a flue;

a rotatable plate in alignment with and connecting to said cylindrical frame base by a plurality of torsion springs for urging said plate away from said top peripheral edge of said cylindrical frame base, a cap for covering said open window area and said plate, said cap sized and shaped for cooperative engagement with said top peripheral edge of said cylindrical frame base;

means attaching said plate to said cap and for pulling said plate and said cap downward for cooperative engagement with said top peripheral edge of said cylindrical frame base;

retainer means for rotational attachment of a distal end of said torsion springs to said cylindrical base frame;

lug means for limiting rotational movement of said torsion springs with respect to said means for attaching said torsion springs to said cylindrical base frame;

each one of said torsion springs attaching to said cylindrical frame base extending upward to said plate and extending over a top peripheral edge of said plate and are bent at a selected acute angle said torsion spring bent at a selected angle for extending from said peripheral edge of said plate and held in rotatable position by a first positioning clip means attached to a surface of said plate, said torsion spring extending across said surface of said plate and rotatably held in position by a second positioning clip means attached to said surface of said plate, said distal end of said torsion spring extending from said second positioning means at a selected angle biased against said surface of said plate defining a stop means whereby upward or downward motion of said plate in alignment with said cylindrical base frame results in bending and twisting of said torsion springs; and whereby pulling said means for attaching said cap to said plate simultaneously bends, twists, and compresses said torsion springs against resilient bias toward said top peripheral edge of said cylindrical frame base wherein said cap cooperatively and releasably engaging said top peripheral edge of said cylindrical frame base.

14. The flue damper as defined in claim 13 wherein said means attaching said plate to said cap and for pulling said plate and said cap downward for cooperative engagement with said top peripheral edge of said cylindrical frame base comprises a cable and handle combination, said cable having a first free end connected to said cap assembly and a second free end connected to said handle.

15. A flue damper comprising:

a frame comprising a cylindrical frame base having a top peripheral edge surrounding an open window area and a bottom peripheral edge with a flange sized and shaped for cooperative engagement with a top distal end of a flue;

said frame includes a skirt extending from a bottom peripheral edge of said cylindrical frame base, said skirt including a peripheral flange of a selected size and shape for cooperative engagement over a top distal end of a flue having a corresponding size and shape;

a rotatable plate in alignment with and connecting to said cylindrical frame base by a plurality of torsion springs for urging said plate away from said top peripheral edge of said cylindrical frame base, a cap for covering said open window area and said plate, said cap sized and shaped for cooperative engagement with said top peripheral edge of said cylindrical frame base;

means attaching said plate to said cap and for pulling said plate and said cap downward for cooperative engagement with said top peripheral edge of said cylindrical frame base;

retainer means for rotational attachment of a distal end of said torsion springs to said cylindrical base frame;

lug means for limiting rotational movement of said torsion springs with respect to said means for attaching said torsion springs to said cylindrical base frame;

each one of said torsion springs attaching to said cylindrical frame base extending upward to said plate and extending over a top peripheral edge of said plate and are bent at a selected acute angle said torsion spring bent at a selected angle for extending from said peripheral edge of said plate and held in rotatable position by a first positioning clip means attached to a surface of said plate, said torsion spring extending across said surface of said plate and rotatably held in position by a second positioning clip means attached to said surface of said plate, said distal end of said torsion spring extending from said second positioning means at a selected angle biased against said surface of said plate defining a stop means whereby upward or downward motion of said plate in alignment with said cylindrical base frame results in bending and twisting of said torsion springs; and whereby pulling said means for attaching said cap to said plate simultaneously bends, twists, and compresses said torsion springs against resilient bias toward said top peripheral edge of said cylindrical frame base wherein said cap cooperatively and releasably engaging said top peripheral edge of said cylindrical frame base.

16. The flue damper as defined in claim 15 wherein said means attaching said plate to said cap and for pulling said plate and said cap downward for cooperative engagement with said top peripheral edge of said cylindrical frame base comprises a cable and handle combination, said cable having a first free end connected to said cap assembly and a second free end connected to said handle.

* * * * *